US012137763B2

(12) United States Patent
Dazeley et al.

(10) Patent No.: US 12,137,763 B2
(45) Date of Patent: Nov. 12, 2024

(54) HAIR RETAINER FOR A HELMET

(71) Applicant: Jonifer Enterprises Pty Ltd, Castle Hill (AU)

(72) Inventors: Jon Dazeley, Castle Hill (AU); Jennifer Burch, Castle Hill (AU)

(73) Assignee: Jonifer Enterprises Pty Ltd, Castle Hill (AU)

( * ) Notice: Subject to any disclaimer, the term of this patent is extended or adjusted under 35 U.S.C. 154(b) by 490 days.

(21) Appl. No.: 16/230,825

(22) Filed: Dec. 21, 2018

(65) Prior Publication Data

US 2019/0191807 A1 Jun. 27, 2019

(30) Foreign Application Priority Data

Dec. 22, 2017 (AU) ..... 2017905185

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/105; A42B 1/066; A42B 1/067; A42B 1/225; A45D 8/40
USPC ..... 2/410
See application file for complete search history.

(56) References Cited

U.S. PATENT DOCUMENTS 2,255,708 A * 9/1941 Laughton ..... A42B 1/049 132/274
D133,490 S * 8/1942 Burns ..... D2/867
3,609,763 A * 10/1971 Raney ..... A42B 3/105 2/415
3,825,952 A * 7/1974 Pershing ..... A42B 3/105 2/422
4,017,906 A * 4/1977 Bochynsky ..... A42B 3/0473 2/10
4,697,289 A * 10/1987 Luigi ..... A42B 3/105 2/205
5,095,550 A * 3/1992 Perlinger ..... A42B 3/105 2/410
5,245,707 A * 9/1993 Green ..... A41D 27/136 2/54
5,406,964 A * 4/1995 Calleja ..... A61F 13/148 128/846

(Continued)

FOREIGN PATENT DOCUMENTS

CN 2624661 Y 7/2004
CN 206213372 U 6/2007

(Continued)

OTHER PUBLICATIONS

The American Heritage® Dictionary of the English Language, Fifth Edition copyright © 2022 by HarperCollins Publishers. https://www.ahdictionary.com/word/search.html?q=pouch. Last visited Mar. 2024.*

(Continued)

*Primary Examiner* — Alissa L Hoey
(74) *Attorney, Agent, or Firm* — Kim IP Law Group LLC

(57) ABSTRACT

Disclosed herein is a hair retainer for a helmet. The hair retainer comprises a helmet mounting portion configured for mounting the hair retainer to a back edge or an underside of the helmet and a hair retaining portion locatable at an underside of the helmet in a hair retaining configuration for retaining hair thereat whilst a user is wearing the helmet.

9 Claims, 7 Drawing Sheets

(56) References Cited

U.S. PATENT DOCUMENTS 5,595,199 A * 1/1997 Solomon ..... A45D 8/00 132/273
D385,658 S * 10/1997 Brandenburg ..... D2/883
5,701,609 A * 12/1997 Bridges ..... A42B 3/105 2/172
5,727,575 A * 3/1998 Rontal ..... A45D 8/34 132/200
5,885,910 A * 3/1999 Graichen ..... D06M 23/16 442/101
6,289,521 B1 * 9/2001 Ikeda ..... A42B 3/326 2/421
6,295,652 B1 * 10/2001 Mazur ..... A42B 3/0473 2/422
6,308,343 B1 * 10/2001 Arai ..... A42B 3/105 2/414
6,735,783 B2 * 5/2004 Phillips ..... A42B 1/041 2/202
D572,438 S 7/2008 Chun
7,437,777 B2 * 10/2008 Marquardt ..... A42B 1/043 2/202
7,805,775 B2 * 10/2010 Ikeda ..... A42B 3/105 2/415
8,136,534 B2 * 3/2012 D'Assis ..... A45D 8/36 132/56
8,327,465 B2 * 12/2012 Arai ..... A42B 3/0473 2/415
D715,033 S * 10/2014 Barr ..... D2/886
9,021,617 B2 * 5/2015 Asta ..... A42B 3/105 2/422
2006/0048277 A1 * 3/2006 Yeadon ..... A42B 1/225 2/204
2009/0064385 A1 * 3/2009 Crossman ..... A42B 3/105 2/6.6
2010/0107318 A1 * 5/2010 Asta ..... A42B 3/105 2/424
2011/0145976 A1 * 6/2011 Osgood ..... A45D 8/40 2/174
2012/0317699 A1 * 12/2012 Barr ..... A42B 1/067 2/209.13
2016/0128411 A1 * 5/2016 Ayres ..... A42B 1/008 2/172
2018/0110656 A1 * 4/2018 Ambring ..... A41D 13/0518
2019/0045864 A1 * 2/2019 Teat ..... A42B 1/225
2019/0090556 A1 * 3/2019 Ayres ..... A42B 1/205
2019/0387827 A1 * 12/2019 Hylton ..... A42B 3/105
2020/0253311 A1 * 8/2020 Niedermeyer ..... A42B 1/14

FOREIGN PATENT DOCUMENTS

CN 103284391 A 9/2013
CN 204393474 U 6/2015
EP 1949808 A2 7/2008
ES 1200286 U2 11/2017
TW M412634 U 10/2011
WO 2006114669 A1 11/2006
WO 2015064968 A1 5/2015

OTHER PUBLICATIONS

Australian International-Type Search Report dated Dec. 3, 2018 in the Australian Provisional Patent Application No. 2017905185 filed on Dec. 22, 2017.
European Search Report issued Jul. 1, 2019 in European Patent Application No. 18215042.

* cited by examiner

DETAIL A

HAIR RETAINER FOR A HELMET

CROSS-REFERENCE TO RELATED APPLICATIONS

This application claims foreign priority to Australian Patent Application No. 2017905185, filed Dec. 22, 2017, the entire disclosure of which is hereby incorporated by reference herein in its entirety for all purposes.

TECHNICAL FIELD

The present invention relates to a hair retainer for a helmet and, in a particular form, to a hair retainer for a motorcycle helmet.

BACKGROUND ART

Helmets are used in many situations to protect the user's head from potential injury. For example, motorcycle helmets are mandatory for riders of motorcycles and can help to prevent head injuries in the event of an accident. However, motorcycle helmets are not without their problems, with their necessarily tight fit often causing discomfort and lack of ventilation.

Motorcyclists that have long hair often leave their hair outside of their helmet, where it becomes tangled and knotted from the wind when riding. The user may simply tuck their hair up into the helmet (if they can get it to remain in place), but the tucked-up hair would typically be uncomfortable and reduce ventilation. Some products have been developed to contain the user's long hair and prevent this problem, but these tend to be time consuming to fit, uncomfortable to wear and/or leave the user's hair looking less than ideal post-ride. For example, protective covers for the hair are provided in the form of a tight cap or bandanna for wearing on the head, or in the form of a long sock type device designed to cover a pony tail. These covers, however, require some sort of preparation of the hair before the helmet is worn and will remain on the hair after the helmet is removed, necessitating a two-step process to mount and remove the helmet and hair protection. In addition, these caps/bandanas hold the user's hair tightly against their head, which can cause discomfort when the helmet is worn due to the already tight fit, and reduce ventilation inside the helmet even further. Other products are difficult to access once the helmet is being worn, making the process of gathering the user's hair for its containment unwieldy and inconvenient.

Helmets are also worn in many other situations, including where exposed long hair might be dangerous (e.g. in the construction industry) or otherwise detrimental (e.g. in the food manufacturing industry). Hair management solutions for use with these helmets, where available, are also generally unsatisfactory.

SUMMARY OF INVENTION

In a first aspect, the present invention provides a hair retainer for a helmet. The hair retainer comprises a helmet mounting portion configured for mounting the hair retainer to a back edge or an underside of the helmet and a hair retaining portion which is locatable at an underside of the helmet in a hair retaining configuration for retaining hair thereat whilst a user is wearing the helmet.

The hair retainer of the present intention can advantageously be mounted to a helmet (e.g. a motorcycle helmet), with the wearer of the helmet being able to avoid tangled and knotted hair when riding due to it being retained by the hair retaining portion. In effect, the hair retaining portion provides a surface, pocket, or the like, which is proximal to the nape of the user's neck and upon which their hair can reside. The user's hair is thus effectively carried within the confines of the helmet where wind is much less of an issue, but not inside of the helmet which would have the attendant disadvantages described above.

Also advantageously, the hair retainer is attachable to the helmet at its back edge or underside, and not inside of the helmet. This increases the comfort and usability of the retainer, compared to existing products which are attached to and sometimes stored an interior of the helmet.

Also advantageously, a hair retainer mounted to the helmet would typically remain attached to the helmet during use, meaning that there is nothing additional for the user to carry. Removal of the helmet may be achieved in a single operation, with the user's hair simply falling out of the retaining portion as the helmet is removed.

In some embodiments, the hair retaining portion may be moveable between its hair retaining configuration and a hair receiving configuration whilst the user is wearing the helmet (i.e. to which the hair retainer has been mounted). In such embodiments, the hair retainer may be operable by the user to easily secure their hair in the hair retaining portion in only a few seconds (bearing in mind that it will not be visible to the user whilst they are wearing the helmet and that they will be working by feel), and once the helmet is in place (noting that existing products take longer to secure the user's hair and often require the helmet to be removed to do so).

In some embodiments, the hair retaining portion may be biased towards the hair retaining configuration. In some embodiments, the hair retaining portion may be resiliently deformable from the hair retaining configuration into the hair receiving configuration. In such embodiments, all that would be required to retain the user's hair would be to pull the hair retaining portion into its hair receiving configuration, tuck the user's hair into the hair retaining portion and then let go, whereupon the hair retaining portion returns to its normal hair retaining configuration.

The helmet mounting portion is configured to be mounted to a lower portion of the rear of the helmet (i.e. the back edge or underside of the helmet). The helmet mounting portion may, for example, have a shape corresponding to the back edge or underside surface of the helmet. The helmet mounting portion may, for example be configured to conform to an underside rim of the helmet. The helmet mounting portion may, for example, be defined by a substantially c-shaped frame which the hair retaining portion spans.

In some embodiments, the helmet mounting portion may be configured to be releasably mountable to the helmet. The hair retainer may, in such embodiments, be removed from the helmet, for example, if another user who does not have long hair wants to use the helmet.

In some embodiments, the helmet mounting portion may comprise a first member configured to be permanently attached to the helmet and a second member that is releasably connectable to the first member in order to releasably mount the hair retainer to the helmet. The first member may, for example, comprise a plurality of members configured to be permanently attached to the helmet at separate locations. The first member may, for example, be adherable to the helmet. The first member may, for example, comprise an adhesive strip (or strips) and one or more fasteners, each of which are configured to receive corresponding fasteners of the second member. The first and second members may, for example, be releasably connectable via hook and loop fasteners, snap fasteners, interference fit fasteners, magnetic fasteners or a combination of such fasteners.

In a second aspect, the present invention provides a helmet comprising a hair retainer, the hair retainer comprising a helmet mounting portion for mounting the hair retainer to a back edge or an underside of the helmet and a hair retaining portion located at an underside of the helmet in a hair retaining configuration for retaining hair thereat whilst a user is wearing the helmet.

In embodiments of the second aspect of the present invention, the hair retainer may be as described herein in the context of the hair retainer of the first aspect of the present invention.

In a third aspect, the present invention provides a kit of parts which, when assembled, provide the hair retainer of the first aspect of the present invention.

Additional features and advantages of the various aspects of the present invention will be described below in the context of specific embodiments. It will be appreciated, however, that such additional features may have a more general applicability in the present invention than that described in the context of these specific embodiments.

BRIEF DESCRIPTION OF DRAWINGS

Embodiments of the present invention will be described in further detail below with reference to the following drawings, in which.

DESCRIPTION OF EMBODIMENTS

Figure 1:
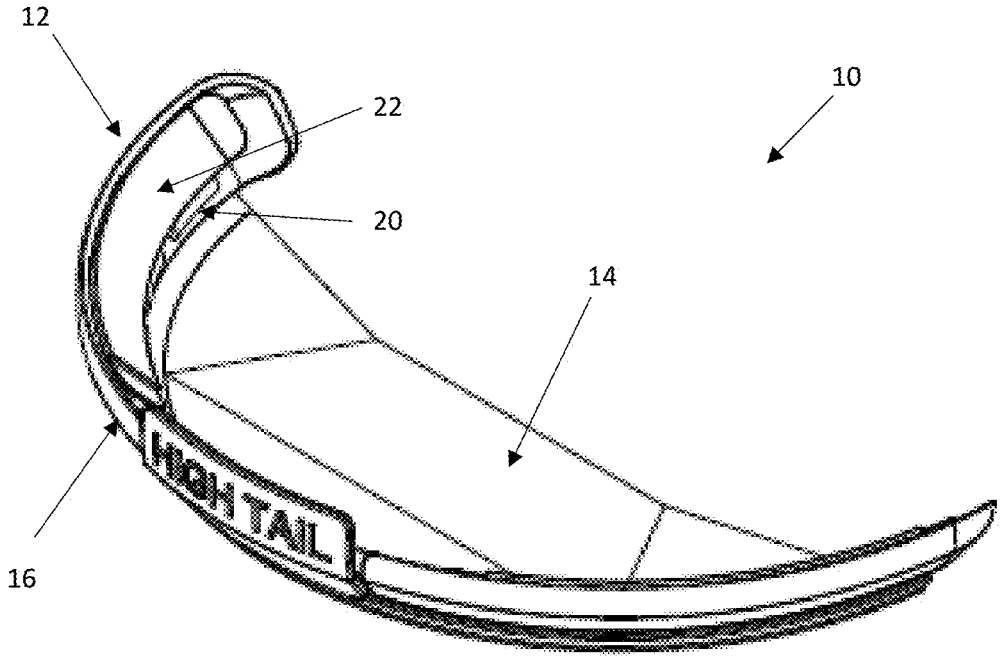
FIG. 1 shows a perspective view of a hair retainer for a helmet in accordance with an embodiment of the present invention.

As described herein, the overarching purpose of the present invention is to provide a hair retainer that enables a user to relatively easily keep their hair in a sheltered position with respect to the helmet, where it cannot become tangled or exposed to other dangers in use, but without too adversely affecting the wearability of the helmet. Thus, the present invention provides a hair retainer for a helmet. The hair retainer comprises a helmet mounting portion configured for mounting the hair retainer to a back edge or an underside of the helmet and a hair retaining portion which is locatable at an underside of the helmet in a hair retaining configuration for retaining hair thereat whilst a user is wearing the helmet.

As used herein in the context of the present invention, the term "hair" is to be understood to mean long hair, of the kind that would ordinarily protrude out from a helmet and be susceptible to tangling/knotting or being exposed to dangers in use of the helmet.

The present invention has application for use with any type of helmet that may be worn by a person. The application most commonly referred to herein is in combination with a motorcycle helmet, but it will be appreciated that helmets are used in many other circumstances. Non-limiting examples of helmets with which the present invention may be used include, for example, bicycle helmets, construction hard hats, etc.

The hair retainer comprises a helmet mounting portion configured for mounting the hair retainer to a back edge or an underside of the helmet. The helmet mounting portion may take any form which enables it to be mounted to this part of the helmet and achieve the functionality described herein. The form of the helmet mounting portion will depend primarily on the type of helmet upon which it is to be mounted, and it is within the ability of a person skilled in the art, based on the teachings contained herein, to devise appropriate forms for the helmet mounting portion for any given helmet.

The helmet mounting portion is configured to be mounted to a lower portion of the rear of the helmet, namely the back edge or an underside surface of the helmet, this being a convenient mounting location (and one that is readily accessible if retrofitting the retainer to a helmet) that is typically proximal to a user's hair in use. As will be appreciated, this is also a section of a helmet which is far less subject to the space restrictions inside of the helmet, which may help to improve the user's comfort. Some motorcycle helmets have a trim which extends around a periphery of the edge of the helmet, which can provide a very convenient surface onto which the helmet mounting portion may be mounted.

The helmet mounting portion may, for example, have a shape that corresponds to the back edge or underside of the helmet. Once mounted, the hair retainer may closely conform to the underside of the helmet, achieving its functionality but without adding significant bulk to the helmet which might adversely affect its appearance, comfort or safety. Further, a more secure attachment with the helmet would be achieved if the helmet mounting portion and underside of the helmet are complementary in shape.

The helmet mounting portion may be configured to be either permanently mounted or releasably mountable to the helmet, depending on the desired use of the helmet/hair retainer. For example, helmets may be sold with the hair retainers of the present invention permanently pre-mounted thereto. Alternatively, a user may want to be able to selectively use the hair retainer, and the helmet mounting portion thus be releasably mountable to the helmet. For example, if a motorcycle rider having long hair wanted to lend their helmet to another person who does not have long hair, they could simply remove the retainer.

The helmet mounting portion may be mounted to the helmet using any suitable means, such as via fasteners (e.g.

staples, screws, etc.), adhesives (e.g. permanent or removable adhesives), clips (e.g. which engage with edges of the helmet), magnets, etc.

The helmet mounting portion may be provided as a single component, or may be provided as a number of components which, once assembled, provide the functionality described herein. In some embodiments, for example, the helmet mounting portion may include two components: a first member configured to be permanently attached (note the comments below regarding "permanently" not meaning that the first member cannot be removed from the helmet) to the helmet and a second member that is releasably connectable to the first member in order to (releasably) mount the hair retainer to the helmet.

The first member may, for example, include a plurality of members configured to be permanently attached to the helmet at separate locations (e.g. at opposite edges of the helmet and/or a central position on the helmet). These members may be attached to the helmet using any suitable means, including using fasteners such as screws or staples, or suitable adhesives. In some embodiments, a removable adhesive may be used, which would provide an effectively permanent attachment between the first member (or indeed, the helmet mounting portion as a whole) and the helmet, but whilst enabling the user to remove the first member(s) without damage to the helmet, should they ever want to.

The second member may take any suitable form, provided that it can interrelate with the first member such that the hair retainer becomes mounted to the helmet. In some embodiments, for example, the second member (or indeed, the helmet mounting portion as a whole) may define a substantially c-shaped frame which the hair retaining portion spans. Such a frame can be configured to conform to the underside of any given helmet and thus provide a second member (helmet mounting portion) having a footprint that is essentially the same as that of the underside of the helmet.

In other embodiments, the first member(s) may be adhered (for example) to a surface at the back edge or underside of the helmet, for example, to the rim at the bottom of the helmet or to the trim which extends around the exterior of the side of the helmet (e.g. if the user does not want to deface the helmet itself). In such embodiments, the second member may define a rim having a complementary shape to that of the lower back edge of the helmet, with the hair retaining portion defining a "hammock-like" structure therebetween.

The first and second members of the helmet mounting portion may be releasably connectable to each other in any manner that enables the hair retainer to be releasably mounted to the helmet. The first member may, for example, include one or more fasteners, the one or more fasteners being configured to receive corresponding fasteners of the second member. The first and second members may, for example, be releasably connectable via hook and loop fasteners (such as Velcro™, or its like, or other mechanical fasteners), snap fasteners, interference fit fasteners, magnetic fasteners, etc. In some embodiments, combinations of these fasteners could be used, if doing so might provide advantages.

In a particular embodiment (described in further detail below), the first member is provided in the form of two clips shaped to conform to the trim at opposing lower rear edges at the bottom of a helmet. The helmet-facing sides of the clips (i.e. those which are to be received on the helmet) may, for example, include an adhesive similar to that used with the 3M™ VHB™ range of removable wall hooks sold by 3M, which securely attaches the clips to the helmet. Alternatively, the helmet-facing sides of the clips may, for example, include an adhesive similar to that used with the Command™ range of removable wall hooks sold by 3M, which securely attaches the clips to the helmet, but in a manner where they can be removed, should the user ever wish to do so. The clips include a plurality of lateral apertures therethrough, which are shaped to receive corresponding tabs on the helmet-facing surface of the second member. Sliding the tabs of the second member into the apertures of the clips results in the second member becoming releasably attached to the helmet. The tabs/clips may include features that provide a snap- or interference-fit when the members are joined in order to hinder the removal of the second member and hence prevent accidental or unintentional decoupling.

The helmet mounting portion (and its components, where it is provided in such a form) may be made from any suitable material. Typically, the helmet mounting portion would be made of a suitable plastics or silicone materials, these being light weight and compatible with materials typically found in helmets.

The hair retainer also comprises a hair retaining portion which is locatable at an underside of the helmet in a hair retaining configuration for retaining hair thereat when the user is wearing the helmet. In effect, the hair retaining portion is, in use, positioned where it can effectively retain the user's hair. The hair retaining portion may take any form which enables it to retain the user's hair and achieve the functionality described herein. The user's hair need not be physically restrained (e.g. in a ponytail, or the like), all that is important is that the gathered hair remain in the hair retainer during use of the helmet. The particular form of the hair retainer's hair retaining portion will depend on factors such as the type of helmet with which it is being used and the length of the user's hair, and it is within the ability of a person skilled in the art, based on the teachings contained herein, to devise appropriate forms of the helmet retaining portion for any given helmet and hair retainer.

The hair retaining configuration may be any configuration and position where the user's long hair can comfortably be positioned and where it is protected from exposure to the environment (e.g. the wind that may be being experienced by the user during use of a motorcycle helmet). The retained hair is held in the space defined by the nape of a user's neck, the hair retaining portion and the underside of the helmet. As would be appreciated, this is outside of the helmet (where space is extremely limited) but is an area that enjoys shelter from the elements.

The hair retaining portion may, in some embodiments be provided by a pouch (such as a substantially c-shaped pouch or substantially dome shaped pouch) or a pocket into which the user's hair can be placed, the pouch/pocket being located in use at the hair retaining position (and in its hair retaining configuration) at the underside of the helmet. For ease of use, the hair retaining portion may be adapted to be moveable between the hair retaining configuration and a hair receiving configuration whilst the user is wearing a helmet (i.e. to which the hair retainer has been mounted). In such embodiments, the hair retainer may be operable by the user to easily secure their hair in the hair retaining portion relatively quickly and even after the helmet is in place (which would be, by far, the most practical time for them to do so).

In some embodiments, the hair retaining portion may be biased towards the hair retaining configuration in order to even further simplify the hair retaining process. All the user need do after donning their helmet in such embodiments would be to grab the hair retaining portion and move it into its hair receiving configuration, place their hair into the hair retaining portion and let go, whereupon the hair receiving portion (and the hair contained thereat) moves back into its hair retaining configuration.

In some embodiments, for example, the hair retaining portion may be resiliently deformable (e.g. stretchable) from its hair retaining configuration to its hair receiving configuration.

The hair retaining portion may, for example, be made from any suitable resiliently deformable material and include features such as a pouch or a pocket into which the hair is receivable in order to simplify or even further or more simply secure the user's hair.

The hair retaining portion may be made from any suitable material, and particularly elastic type materials which are relatively easily deformed. Given that the hair retaining portion will cover a portion of the underside of the helmet where some ventilation may have otherwise been able to occur, a material which breathes may be advantageous. Specific and non-limiting examples of materials from which the hair retaining portion may be made include pleated, elasticated material such as Lycra™, spandex and elastic polymeric material including elastane, polyesters, etc.

The hair retaining portion may be associated with the helmet mounting portion using any suitable technique and depending on the nature of the respective materials being used in the retainer. In some embodiments, for example, the hair retaining portion may be integrally formed with the helmet mounting portion. In some embodiments, for example, the hair retaining portion may be fastened to the helmet mounting portion (e.g. by stitching). In some embodiments, for example, the hair retaining portion may be adhered to the helmet mounting portion.

As noted above, the present invention also provides a helmet and a hair retainer. The hair retainer comprises a helmet mounting portion for mounting the hair retainer to a back edge or underside of the helmet and a hair retaining portion located at an underside of the helmet in a hair retaining configuration for retaining hair thereat whilst a user is wearing the helmet. The present invention also provides a kit of parts which, when assembled, produce the hair retainer of the present invention, as described herein. In embodiments of these aspects of the present invention, the hair retainer may be as described herein.

Also disclosed herein is a hair retainer for a helmet. The hair retainer comprises a helmet mounting portion configured for mounting the hair retainer to the helmet and a hair retaining portion locatable at an underside of the helmet in a hair retaining position and configured to retain hair thereat whilst a user is wearing the helmet.

Also disclosed herein is a helmet and a hair retainer. The hair retainer comprises a helmet mounting portion for mounting the hair retainer to the helmet and a hair retaining portion located at an underside of the helmet in a hair retaining position and configured to retain hair thereat whilst a user is wearing the helmet. The present invention also provides a kit of parts which, when assembled, produce the hair retainer of the first aspect of the present invention.

Specific embodiments of the present invention will now be described with reference to the accompanying drawings. Referring firstly to FIGS. 1 to 4, shown is a hair retainer 10 for a helmet in accordance with an embodiment of the present invention. Hair retainer 10 has a helmet mounting portion including frame 12 and a hair retaining portion in the form of elastic tray 14. Frame 12 is configured for mounting to the back edge of a helmet (as will be described below), and has a shape that conforms to that of the back edge/underside of a helmet and an outer rim 16 which defines an outer housing underneath the helmet in use.

Figure 2:
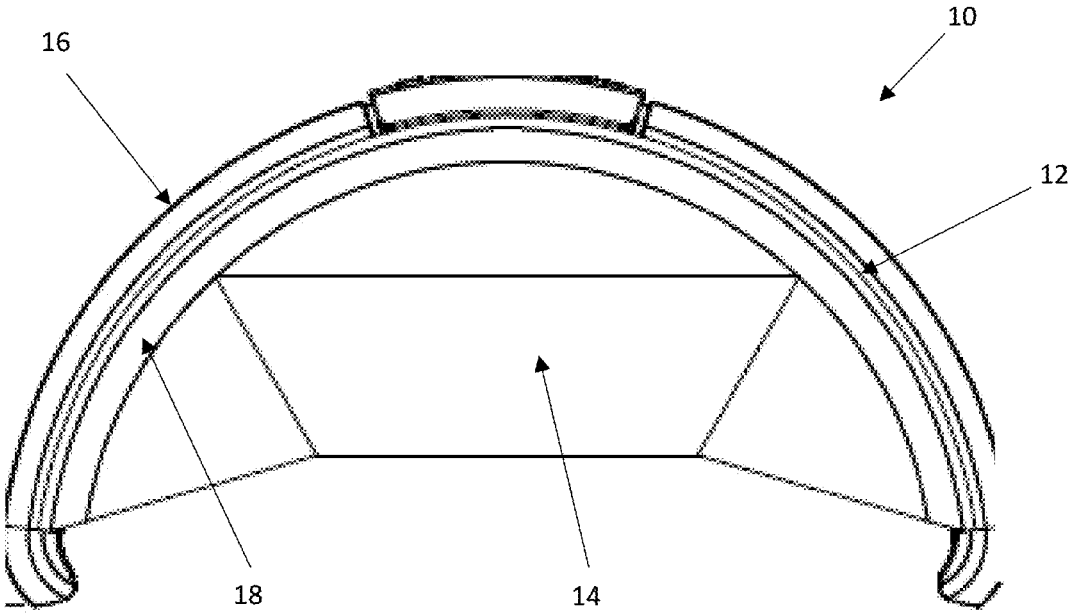
FIG. 2 shows a top view of the hair retainer of FIG. 1.
Figure 3:
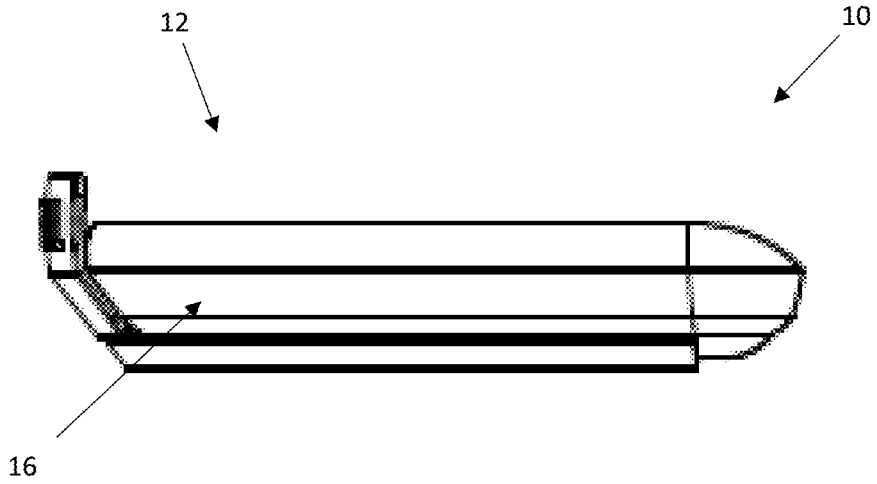
FIG. 3 shows a side view of the hair retainer of FIG. 1.
Figure 4:
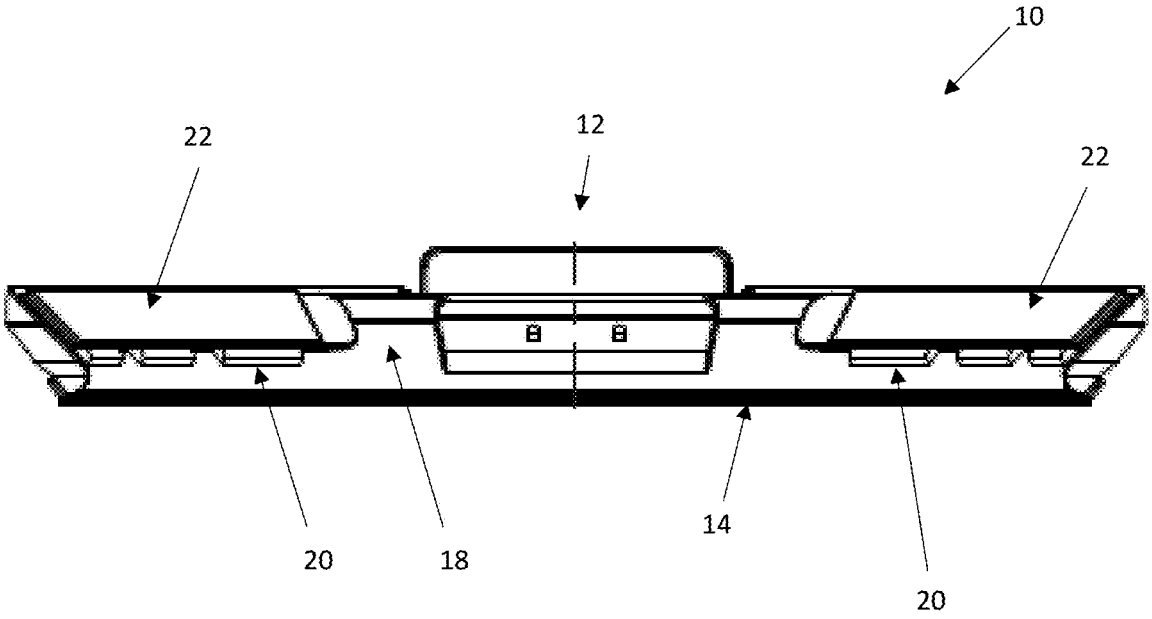
FIG. 4 shows a front view of the hair retainer of FIG. 1.

As can best be seen in FIGS. 2 and 4, the inner side of frame 12 has a skirt 18, above which a plurality of tabs, shown generally as tabs 20, are spaced. Tabs 20 are partially hidden in FIGS. 1 and 4 by clips 22, 22, which are also part of the helmet mounting portion and which are located at opposite sides of the frame 12. Each clip 22 has an adhesive strip provided on its uppermost surface, which can be used to permanently adhere the clips 22, 22 to the back edge/underside of a helmet (as described below). In the event of a user wanting to remove the frame 12 (and hence retainer 10) from the helmet, the frame may be detached from clips 22, 22 by sliding the frame relative to the clips such that the tabs 20 become disengaged from the clips. The tabs 20 and/or clips 22 may be provided with features (such as ridges and grooves, not shown) in order to prevent accidental detachment.

The elastic tray 14 is suspended from and spans the frame 12 and may be stretched downwardly (in use) and away from the frame simply by grabbing and pulling at any convenient/accessible location. Once the user's hair (not shown) is in position on the stretched tray 14, the user can release the tray, whereupon it returns to the configuration shown in FIG. 1. The user's hair is thus retained within the space defined by the tray 14, skirt 18, the lower portion of the helmet and the nape of the user's neck (not shown). In this well-shielded position, it does not get blown about by any wind that may be being experienced outside of the helmet.

Figure 5:
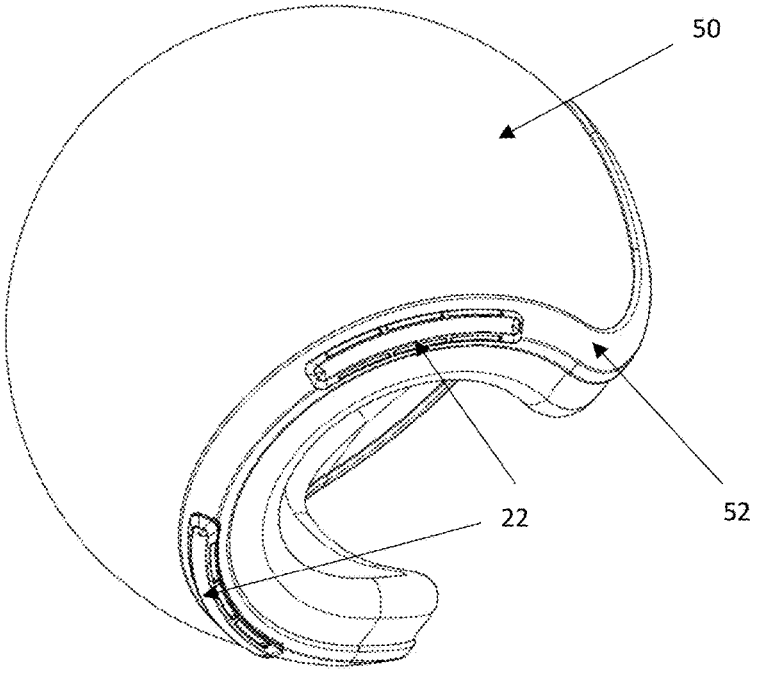
FIG. 5 shows a side perspective view of a helmet upon the underside of which first members of a hair retainer in accordance with an embodiment of the present invention have been mounted.
Figure 6A:
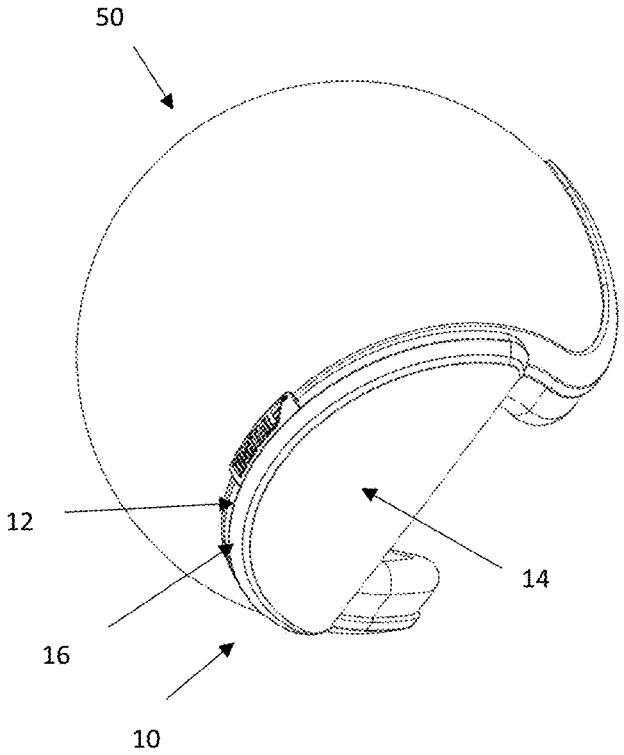
FIGS. 6A and 6B show lower perspective views of the helmet and hair retainer of FIG. 5 in a hair retaining configuration and a hair receiving configuration.
Figure 6B:
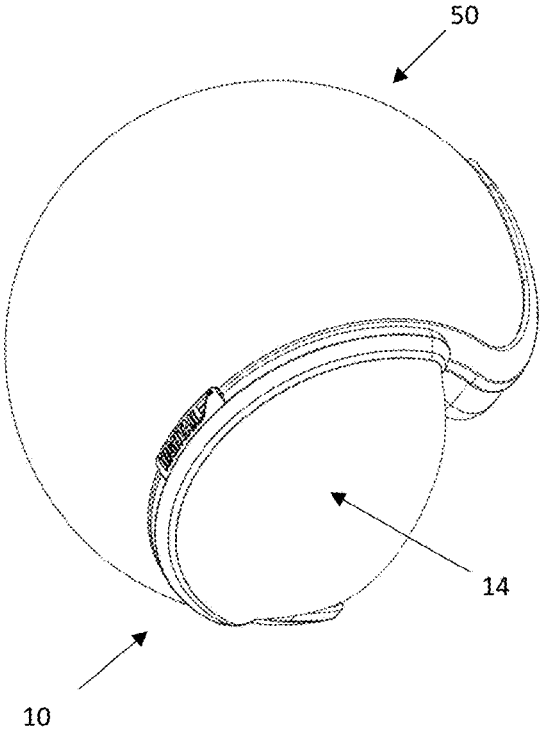

Referring now to FIGS. 5 and 6, hair retainer 10 is shown mounted to a helmet 50. As can be seen in FIG. 5, the clips 22, 22 are mounted to the helmet's underside 52 in order for the retainer 10 to be mounted to the helmet 50 in the manner described above (and as shown in FIGS. 6A and 6B). The frame 12 conforms relatively closely to the back edge and underside of the helmet 50 so as to not detract from the helmet's visual appeal nor its functionality. As can be seen in FIG. 6A, the tray 14 is positioned underneath where a user's hair would usually protrude from the helmet, and thus well-positioned to receive their hair in the manner described herein. As the tray 14 is made of a resiliently deformable material, even should it contact the back of a user's neck, any such contact should not be irritating to the user.

In use, the user puts on the helmet 50 as normal, pushing their head past the resilient tray 14 and into the helmet. Then they gather the hair protruding from the helmet, stretch down the tray 14 (i.e. as shown in FIG. 6B) and place their hair inside. The tray 14 will spring back into place (i.e. as shown in FIG. 6A) when released, thereby securing the user's hair in a space defined by the tray 14, the frame 12/rim 16, the helmet 50 and the user's neck (not shown). In this configuration, their hair is carefully maintained in position and effectively shielded from external environmental factors, especially wind. When the user removes the helmet (as normal), their hair slides off the tray 14, tangle free, without additional steps.

Figure 7:
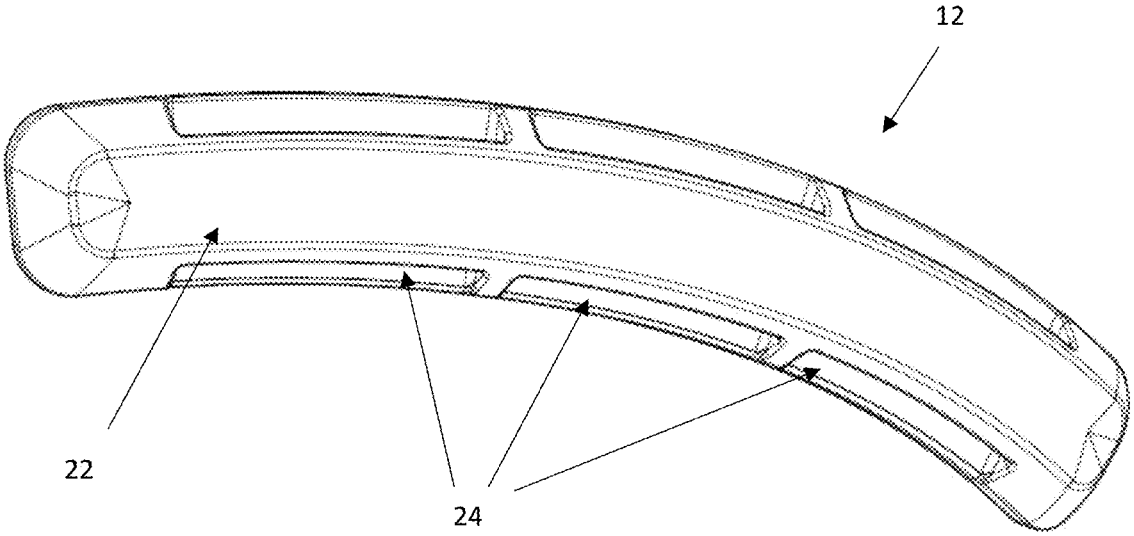
FIG. 7 shows the first member of the helmet mounting portion of the hair retainer for a helmet in accordance with the embodiment of FIG. 5.
Figure 8:
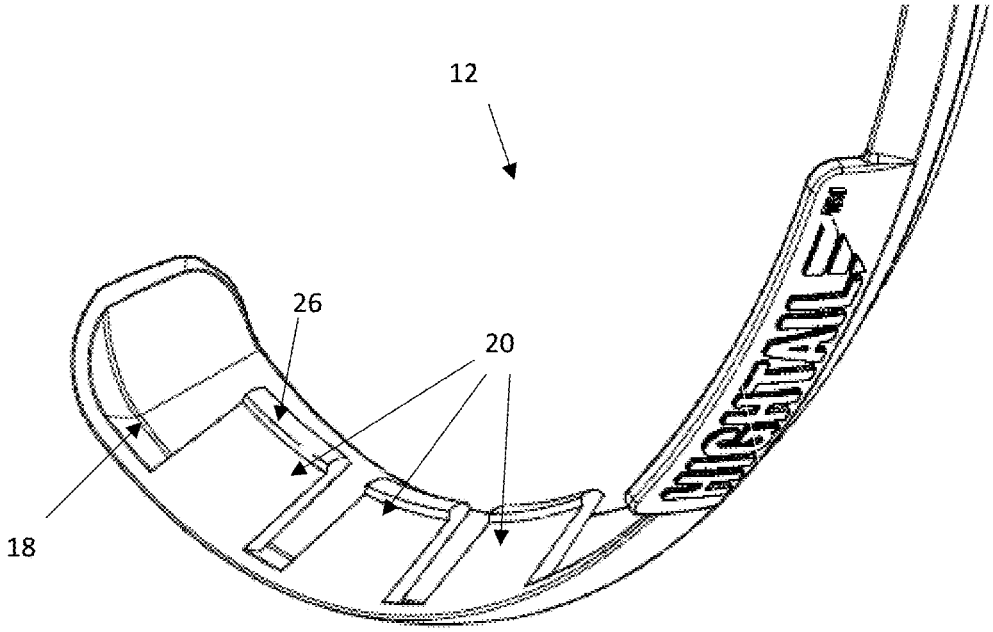
FIG. 8 shows the second member of the helmet mounting portion of the hair retainer for a helmet in accordance with the embodiment of FIG. 5.
Figure 9:
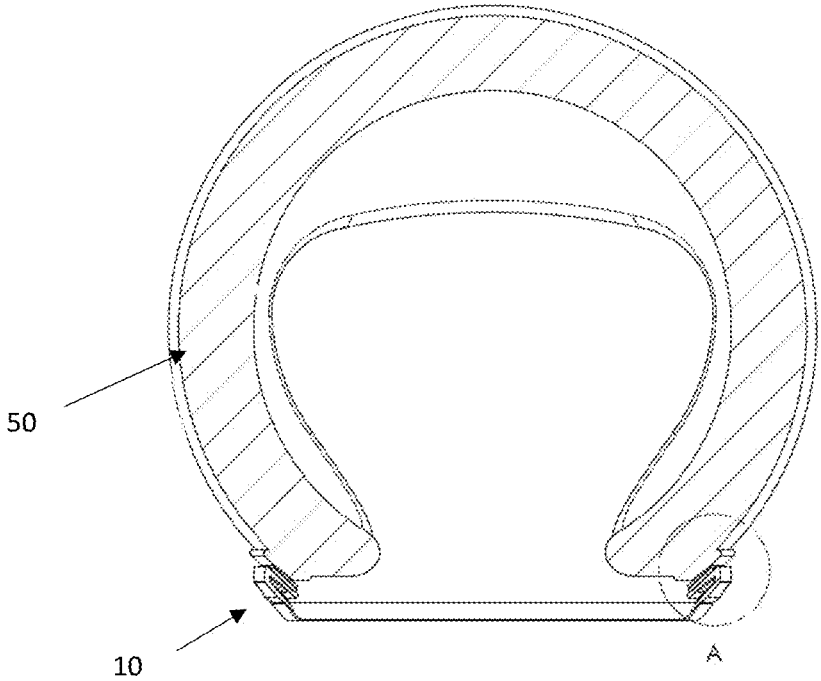
FIG. 9 shows the assembled helmet mounting portion of the hair retainer for a helmet in accordance with the embodiment of FIG. 7.
Figure 9:
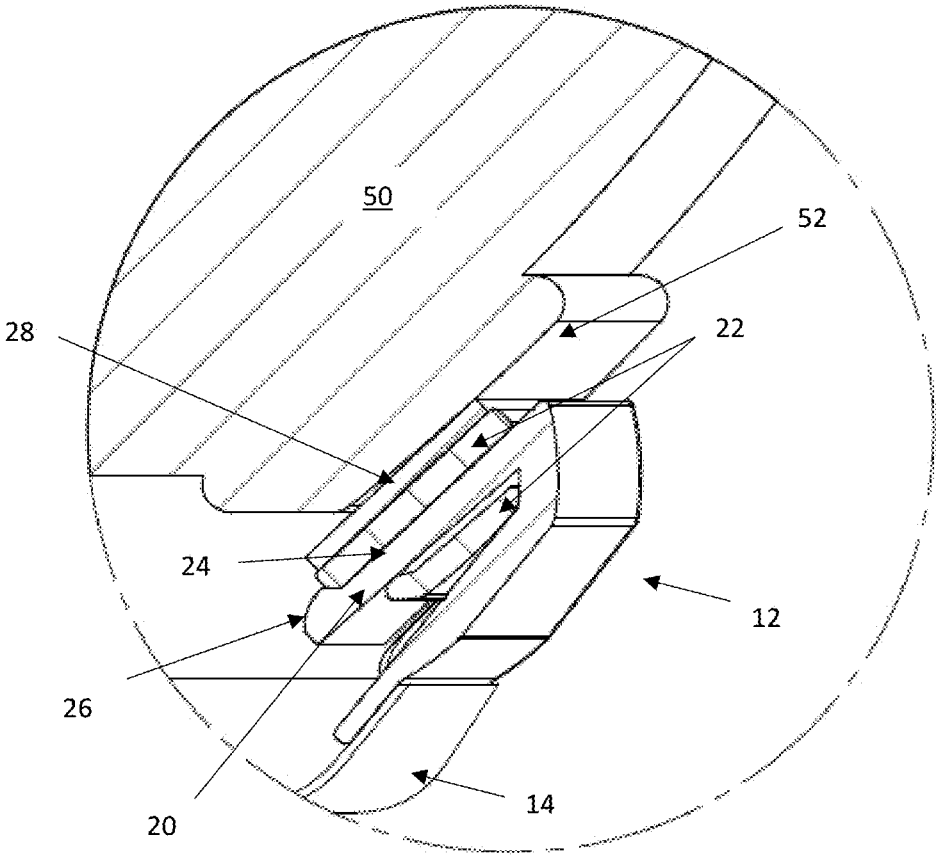

Referring now to FIGS. 7 to 9, the components of the helmet mounting portion are shown in greater detail. FIG. 7 shows first members in the form of the clips 22, 22, FIG. 8 shows a second member in the form of frame 12 and FIG. 9 shows the assembled form of the helmet mounting.

Referring firstly to FIG. 7, each clip 22 has an elongate and curved shape adapted for conformity with the surface on the back trim of a helmet (see FIG. 5). Clip 22 includes three apertures 24, 24, 24, which extend longitudinally between the clip's upper and lower surfaces. Referring now to FIG.

8, the frame's 12 inner skirt 18 and inner tabs 20, 20 20 are shown. As can be seen, each inner tab 20 has a rib 26 at an end thereof, the rib 26 being shaped such that it can fit through a respective aperture 24 but, once passed therethrough, provides a degree of resistance against its removal. This interference-type fit prevents the accidental removal of the hair retainer 10 from a helmet, but whilst still allowing this to occur upon application of a deliberate force.

FIG. 9 shows a cross section of a portion of the helmet 50 to which hair retainer 10 has been attached. A strip of an adhesive material 28 is provided on the helmet-facing surface of the clip 22. When installing the hair retainer 10 to a helmet (e.g. helmet 50), the backing of this adhesive strip 28 would be removed (along with that of the other clip 22), the retainer 10/frame 12 aligned appropriately with the helmet 50 (i.e. as shown in FIG. 5), and the two then pressed together firmly for as long as it takes for the adhesive to form a strong enough bond. The tabs 20, 20, 20 on frame 12 can be seen interlocked with their respective apertures 24, 24, 23 on clip 22, with the ribs 26 preventing inadvertent removal.

The tray 14 would typically be made from an elastic material such as spandex and attached to the frame 12 by stitching. Tray 14 defines a resilient surface located underneath the helmet in use, and provides a secure receptacle for the user's hair. The tray's resilience makes it easy for the user to manipulate the retainer's hair retaining portion (bearing in mind that it will not be visible to the user whilst they are wearing the helmet and that they will be working by feel).

The resilient hair retaining portion could, in alternative embodiments, be made from a soft rubber material which may be more useful in applications where a higher degree of retaining power may be advantageous, although the benefits of this would need to be contrasted with it probably being less deformable than would be the case when hair retaining portions are made from less resilient materials. The resilient hair retaining portion could, in alternative embodiments, be made from a waterproof material and especially a breathable waterproof material such as Goretex™. Even in wet conditions, a user's hair may remain dry if retained in such a hair retainer.

Figure 10:
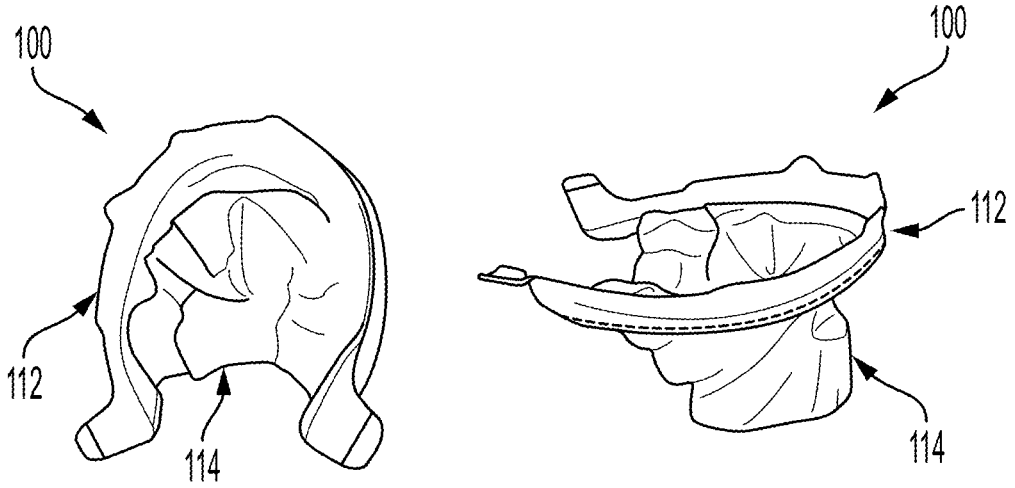
FIG. 10 shows views from different aspects of a hair retainer for a helmet in accordance with another embodiment of the present invention.
Figure 11:
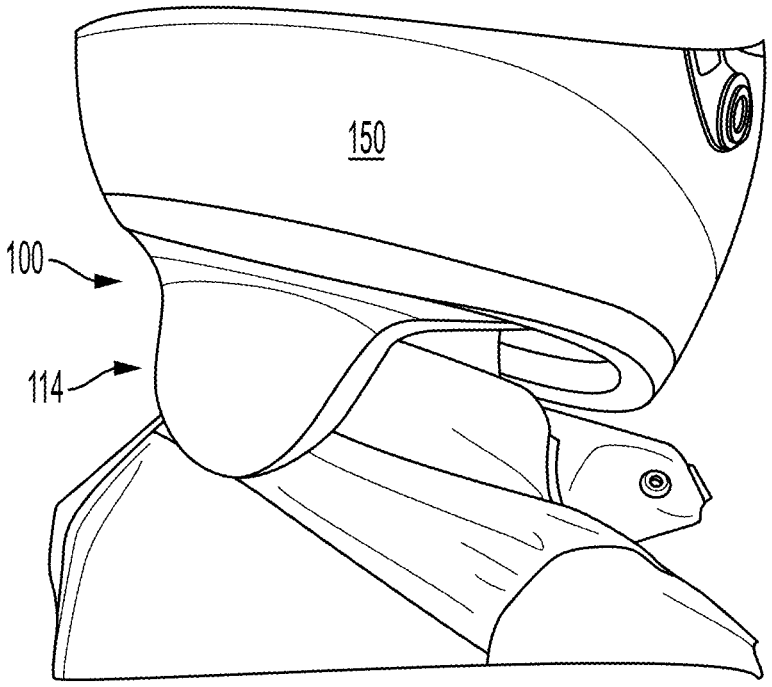
FIG. 11 shows a person with long hair wearing a helmet upon which the hair retainer of FIG. 10 has been mounted.

Referring now to FIGS. 10 and 11, shown is a hair retainer 100 for a helmet 150 in accordance with another embodiment of the present invention. Hair retainer 100 has a helmet mounting portion in the form of frame 112 and a hair retaining portion in the form of a spandex pocket 114. Frame 112 is a plastic member shaped to conform to the lowermost portion of the back of the helmet 150, as can be seen in FIG. 11. The frame 112 can be mounted to the helmet 150 by pushing it into the gap between the plastic outer casing of the helmet and the foam inner. Spandex pocket 114 is stitched to and hangs down from the frame 112, where it is well positioned to receive the helmet wearer's long hair (note the absence of any hair in FIG. 11). The volume inside of spandex pocket 114 is capable of accommodating relatively large amounts of a user's gathered hair.

In use, the person would put on the helmet 150, pull down on the elastic pocket 114 to enlarge its opening, and neatly tuck their hair into the pocket. Releasing the pocket 114 causes it to resiliently return to its normal position, i.e. that shown in FIG. 11. When the person removes the helmet, the retainer 10 remains mounted to the helmet, and their hair will be pulled out of the pocket 114.

Figure 12:
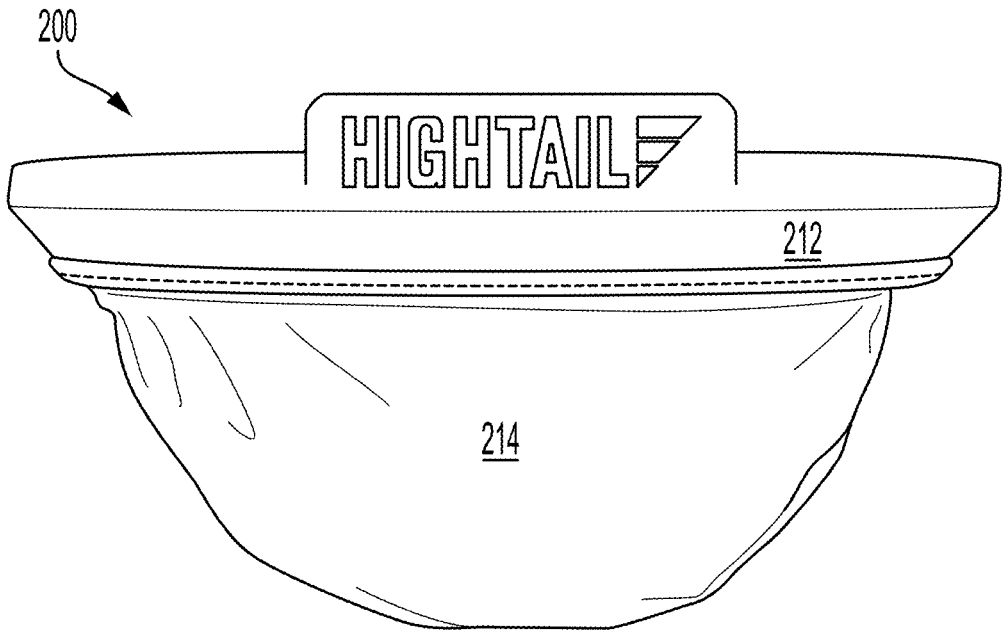
FIG. 12 shows a rear view of a hair retainer for a helmet in accordance with another embodiment of the present invention.
Figure 13:
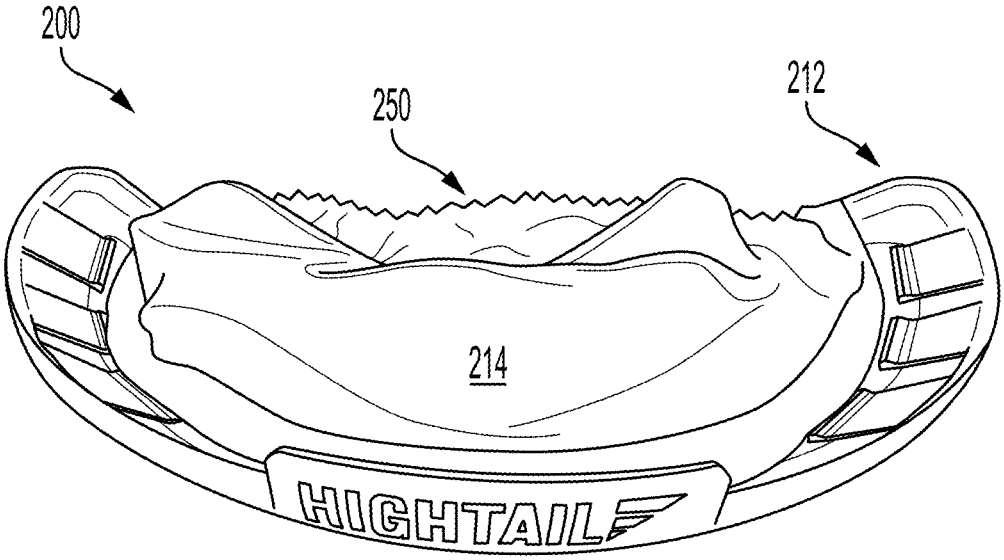
FIG. 13 shows a perspective view of the hair retainer of FIG. 12.

Referring finally to FIGS. 12 and 13, shown is a hair retainer 200 for a helmet (not shown) in accordance with another embodiment of the present invention. Hair retainer 200 has a helmet mounting portion in the form of frame 212 and a hair retaining portion in the form of spandex pocket 214. Frame 212 is essentially the same as frame 12, described above and can also be mounted to the underside rim of a helmet via adhesive tabs. Spandex pocket 214 is stitched to and suspended downwardly from the frame 212, where it is well positioned to receive the helmet wearer's long hair. This embodiment would be well suited for users having relatively long hair, given the relatively large volume of the pocket 214. An elastic strip 250 along the free edge the spandex pocket 214 provides an elastic edge that can be stretched downwardly by a user's finger in order for them to easily place their gathered hair into the pocket 214 and which resiliently returns to the configuration and position shown in FIG. 13, where it acts as a lip for retaining the hair in the pocket. The frame 212 includes a plurality of tabs spaced along its inner side, such as flexible tabs.

In summary, the invention relates to hair retainers which are accessories for helmets and which can be used to securely retain the wearer's long hair tucked away into a pocket below and outside of, but still within the confines of, the helmet.

It will be appreciated that the present invention provides a number of new and useful results. For example, specific embodiments of the present invention may provide one or more of the following advantages:

- The user can easily secure their hair once the helmet is in place, in just a few seconds (all other products take longer to secure or remove the helmet and hair protection);
- The retainer avoids the comfort and overheating issues associated with securing hair in a cap (or bandana) close to the head, against the helmet;
- The retainer is more attractive and discreet than other available products;
- The retainer allows the user's hair to remain in the style they prefer, as their hair sits easily in a protective pocket until the helmet is removed and the hair drops into place; and
- The retainer remains attached to the helmet, so there is nothing else to carry.

It will be understood to persons skilled in the art of the invention that many modifications may be made without departing from the spirit and scope of the invention. All such modifications are intended to fall within the scope of the following claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A hair retainer for a helmet, the hair retainer comprising:
   - a substantially c-shaped helmet mounting frame that includes:
     - a vertical section,
     - an inwardly sloping section extending from the vertical section, and
     - a plurality of tabs spaced along an inner side of the substantially c-shaped helmet mounting frame, wherein each of the plurality of tabs extends downwardly from a proximal end of the vertical section frame; and a dome-shaped pouch suspended from the substantially c-shaped helmet mounting frame for receiving hair from a head of a user, the dome-shaped pouch including:

a free edge comprising an elastic strip stretchable sufficiently for long hair from a head of a user to be placed into the pouch whilst a user is wearing the helmet.

2. The hair retainer of claim 1, wherein each of the plurality of tabs include a rib at an end thereof.

3. The hair retainer of claim 1, wherein each of the plurality of tabs is a flexible tab.

4. The hair retainer of claim 1, wherein the plurality of tabs overlap the inwardly sloping section of the substantially c-shaped helmet mounting frame.

5. The hair retainer of claim 1, wherein the dome-shaped pouch includes pleats.

6. The hair retainer of claim 1, wherein the substantially c-shaped helmet mounting frame is sized sufficiently for mounting to a back underside of a helmet.

7. The hair retainer of claim 1, wherein the substantially c-shaped helmet mounting frame is configured to mount to a back underside of a helmet.

8. The hair retainer of claim 1, wherein the substantially c-shaped helmet mounting frame is configured to align with a profile of a back underside of a helmet.

9. The hair retainer of claim 1, wherein the dome-shaped pouch is sized sufficiently to receive long hair.

* * * * *